US007316621B2

(12) United States Patent
Tufts

(10) Patent No.: US 7,316,621 B2
(45) Date of Patent: Jan. 8, 2008

(54) POLICE BATON

(76) Inventor: Baldwin D. Tufts, 8439 Holtzclaw Rd., Warrenton, VA (US) 20186

( * ) Notice: Subject to any disclaimer, the term of this patent is extended or adjusted under 35 U.S.C. 154(b) by 113 days.

(21) Appl. No.: 11/238,985

(22) Filed: Sep. 30, 2005

(65) Prior Publication Data

US 2007/0238533 A1 Oct. 11, 2007

(51) Int. Cl.
*F41B 15/02* (2006.01)
*A01K 15/00* (2006.01)

(52) U.S. Cl. ..... 473/47.4; 473/47.7; 119/801; 43/6

(58) Field of Classification Search ..... 463/47.2, 463/47.4; 119/712, 801, 806; 294/19.1, 294/19.3; 43/5, 6, 15
See application file for complete search history.

(56) References Cited

U.S. PATENT DOCUMENTS

| | | | | | |
|---|---|---|---|---|---|
| 411,705 | A | * | 9/1889 | Adams | 463/47.4 |
| 443,263 | A | * | 12/1890 | Smith | 463/47.4 |
| 769,880 | A | * | 9/1904 | Trout | 463/47.4 |
| 1,240,005 | A | * | 9/1917 | Arnett et al. | 463/47.4 |
| 1,700,023 | A | * | 1/1929 | Capriles | 463/47.4 |
| 1,727,812 | A | * | 9/1929 | David | 43/6 |
| 2,118,147 | A | * | 5/1938 | Blodgett et al. | 294/26 |
| 2,266,606 | A | * | 12/1941 | Jones | 463/47.4 |
| 2,442,974 | A | * | 6/1948 | Frederiksen | 43/6 |
| 2,484,147 | A | | 10/1949 | Bartel | |
| 4,037,839 | A | | 7/1977 | Nelson | |
| 4,283,051 | A | | 8/1981 | Perez | |
| 4,365,808 | A | | 12/1982 | Perez | |
| 4,517,965 | A | * | 5/1985 | Ellison | 600/204 |
| 4,653,142 | A | * | 3/1987 | Upton | 16/429 |
| 4,819,137 | A | | 4/1989 | Hamilton | |
| 4,986,279 | A | * | 1/1991 | O'Neill | 600/567 |
| 5,041,951 | A | | 8/1991 | Fan | |
| 5,185,565 | A | * | 2/1993 | Uchida | 320/163 |
| 5,482,271 | A | * | 1/1996 | McNutt | 119/808 |
| 5,529,300 | A | | 6/1996 | Frazier et al. | |
| 6,091,597 | A | | 7/2000 | Lin | |
| 7,029,397 | B1 | * | 4/2006 | Barwick | 463/47.4 |

* cited by examiner

*Primary Examiner*—William M. Pierce
(74) *Attorney, Agent, or Firm*—Clark & Brody

(57) ABSTRACT

A handheld device for incapacitating dangerous suspects without endangering nearby civilians. The user holds the handgrip which has a trigger connected to a source of thrust, such as an air cartridge. When the user pulls the trigger, the air cartridge is fired and extends a shaft outwards, which has an end piece at the other end for catching suspects. The end piece unfolds into a flat surface and has needles with retractable barbs attached to the flat surface. These retractable barbs engage the suspect and incapacitate him. A cam inside of the end piece can be operated to retract the barbs and release the suspect.

5 Claims, 4 Drawing Sheets

POLICE BATON

FIELD OF THE INVENTION

The present invention relates generally to devices used to subdue suspects. More specifically, the present invention relates to a device equipped with an air cartridge and an extendable end piece that has needles attached to it for catching and incapacitating a dangerous suspect from a safe distance.

BACKGROUND OF THE INVENTION

Police, security personnel, and similar persons in authority often rely on non-lethal weapons to restrain dangerous individuals. These devices, including batons, stun guns, and tear gas, are powerful enough to incapacitate without actually killing. Additionally, non-lethal weapons are the best way to subdue violent suspects without unnecessarily jeopardizing the public safety.

There is presently a need for incapacitating devices that are more powerful and far-reaching than the simple stick-type baton that can be used to place suspects in custody without endangering nearby civilians.

U.S. Pat. No. 5,529,300 to Frazier attempts to solve this need with a self-powered extensible projectile launching police baton. The device in Frazier relies on a source of gas under pressure to forcefully extend a blunt knob toward a suspect, or alternatively, to launch projectiles at the suspect.

The problem with the prior art is that it cannot reliably subdue a violent suspect. The blunt knob embodiment only operates at very short distances, while the projectile embodiment takes too much time to load and reload and also endangers nearby civilians.

SUMMARY OF THE INVENTION

The device of the present invention can quickly and reliably restrain even the most violent suspect in a non-lethal manner without endangering nearby civilians.

In general, the present invention is a baton-type device having a hand grip at one end, which houses an air cartridge or other device creating a thrusting force. A shaft made up of telescoping tubes connects the handgrip at one end to an end piece equipped with needles at the other end. In a preferred embodiment, the end piece comprises two parts that are folded when not in use and unfold into a flat surface for operation. Alternatively, the end piece does not fold. The tubes have spring-loaded buttons that snap and lock into position when the tubes are fully extended, preferably at an overall length of about 6 to 8 feet. The user can thus engage and restrain even the most violent suspect from a safe distance and hold that suspect indefinitely.

There are several techniques known in the art for connecting a trigger to an air cartridge to release bursts of compressed gas. While a cartridge of compressed air or other gas is the preferred source of thrust to launch the end piece of the present device at a suspect, other sources of thrust that might be used to launch the head outwards, such as springs, chemical explosives (e.g., gunpowder), and other small explosives. One skilled in the art would appreciate all the different sources of thrust that are capable of launching an end piece outwards.

The extendable shaft is made up of a series of telescoping tubes that are housed within each other. The outer tube is the largest tube and is fixed to the handgrip. This outside tube houses a middle tube which is an identical oval shape so that it fits neatly within the outer tube and minimizes any rotational slippage in the clockwise or counterclockwise direction due to the oval shape. In turn, this medium tube houses an inner tube which fits neatly within the middle tube. This inner tube extends out the farthest and is connected to the end piece. It is within the scope of this invention to vary the number of tubes as the user sees fit.

When the user triggers the device, the two halves comprising the end piece unfold into a flat surface with barbed needles. The air cartridge will preferably be powerful enough to cause the end piece to unfold on its own. If not, the simplest way to unfold the end piece is for the user to manually unfold it before triggering the device. It is contemplated that handles could be attached to the outside of the halves for manually unfolding the two pieces.

In another embodiment, springs are attached to the outside of each half as well as the fixed outside tube, unfolding the end piece.

The hollow needles on the end piece have retractable barbs which are positioned in one of two positions: the catch position or the retracted position. In the catch position, barb tips extend outside of a side opening in the hollow needles to engage a suspect. In the retracted position, the barbs are pushed back inside of the hollow needle by a cam which is rotated by the user. The barbs are designed to stay fixed within the material they penetrate, until they are retracted back into the hollow needle.

Once the barbs have engaged the assailant, the device can be used in a number of incapacitating ways.

In one embodiment, the device is simply used to hold the assailant.

In another embodiment, the needles are connected to a high voltage source for shocking the assailant.

In another embodiment, the needles contain a tranquilizer that can be injected into the prisoner to render him unconscious. This embodiment could be used against extremely violent people or even large rampaging animals.

In another embodiment, handcuffs are attached to the end piece so that the user can trigger the device to extend the handcuffs to a suspect without painfully engaging that person.

DETAILED DESCRIPTION OF THE PREFERRED EMBODIMENT

Figure 1:
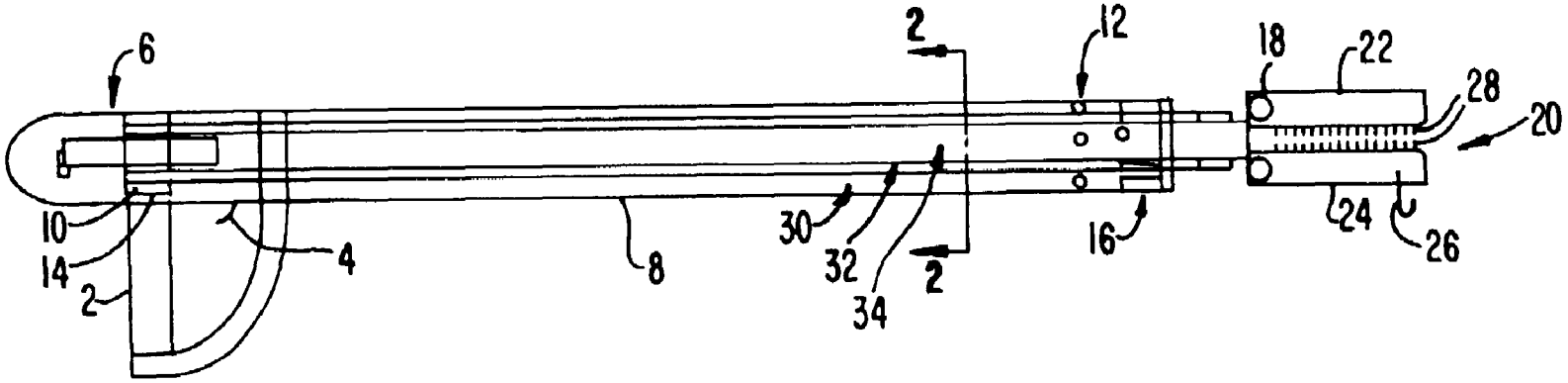
FIG. 1 is a side view of a baton in accordance with the invention prior to use.

Referring now to FIG. 1, the user holds the device by gripping the handgrip 2 with one hand and optionally gripping the shaft 8 with the other hand. The handgrip 2 houses an air cartridge 6 which is connected to a trigger 4. When the user pulls the trigger 4, it releases a pressurized burst from the cartridge 6, which travels through the inner tube 34 to the end piece 20. This pressure powerfully thrusts the end piece 20 outwards.

The air cartridge 6 can be fired with short or long bursts to control speed. The use of compressed-gas cartridges to deploy projectiles is well-known in the art. In another embodiment, the end piece 20 is launched out with the use of springs loaded in the back of the handgrip 2 which snap forward when triggered. In yet other embodiments explosive gasses are used to supply thrust.

Figure 2:
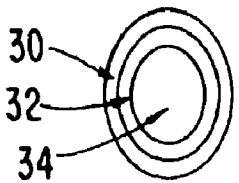
FIG. 2 is a cross-section of the baton of FIG. 1 taken along line 2-2 of FIG. 1.

Referring now to FIGS. 1 and 2, the shaft 4 is preferably comprised of a series of three telescoping oval shaped tubes 30, 32 and 34 which fit inside of each other, respectively. The outer tube 30 is connected on one end to the handgrip 2 by screws or other fasteners, and on the other end to the middle tube 32 by spring buttons 10. The middle tube 32 is connected on one end to the outer tube 30 by spring buttons 10, and on the other end to the inner tube 34 also by spring buttons 10. The inner tube 34 is connected on one end to the middle tube 32 by spring buttons 10, and on the other end to the end piece 20 by rolling pins 18 which allow the halves 22 and 24 to unfold outward.

These rolling pins 18 are well-known in the art and can be any type of rolling pin that facilitates the swinging back movement of the halves from a position parallel with the shaft to a position orthogonal to the shaft. It is contemplated that each of the halves 22 and 24 connects to a corresponding rolling pin, but one skilled in the art could modify this in any number of ways.

Since the tubes 30, 32 and 34 are ovally shaped, not circularly shaped, the spring buttons 10 should stay aligned with their corresponding spring button holes 12. Although spring buttons 10 should lock the middle and inner tubes 32 and 34 into place, stops 14 are built into one end of tubes 32 and 34, with corresponding stop ends 16 built into the other end. When the user pulls the trigger and the end piece projects outward, the stops 14 engage the stop ends 16 at the point of full extension of the shaft 8.

When fully extended, the shaft 8 preferably extends about 6 to 8 feet outwards as measured from the handgrip 2 to the retractable barbs 40. The actual number and shape of the tubes can vary. For instance, the middle tube 32 can be removed, or another tube or tubes can be added.

The tubes are preferably constructed out of a strong, lightweight material, such as carbon fiber, and are preferably coated with TEFLON® to minimize the friction between the tubes during deployment. It is contemplated that any other stretchable material capable of being extended by thrust and locked in an extended position can be used in place of telescoping tubes, such as scissor jacks.

Figure 3:
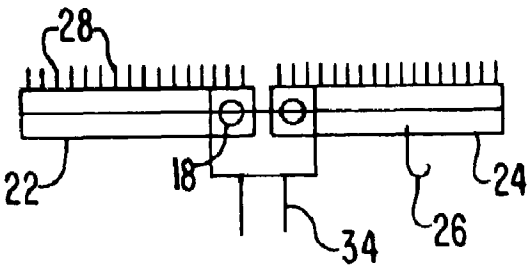
FIG. 3 is a side view of the end piece of the baton of FIG. 1 in an unfolded configuration.
Figure 4:
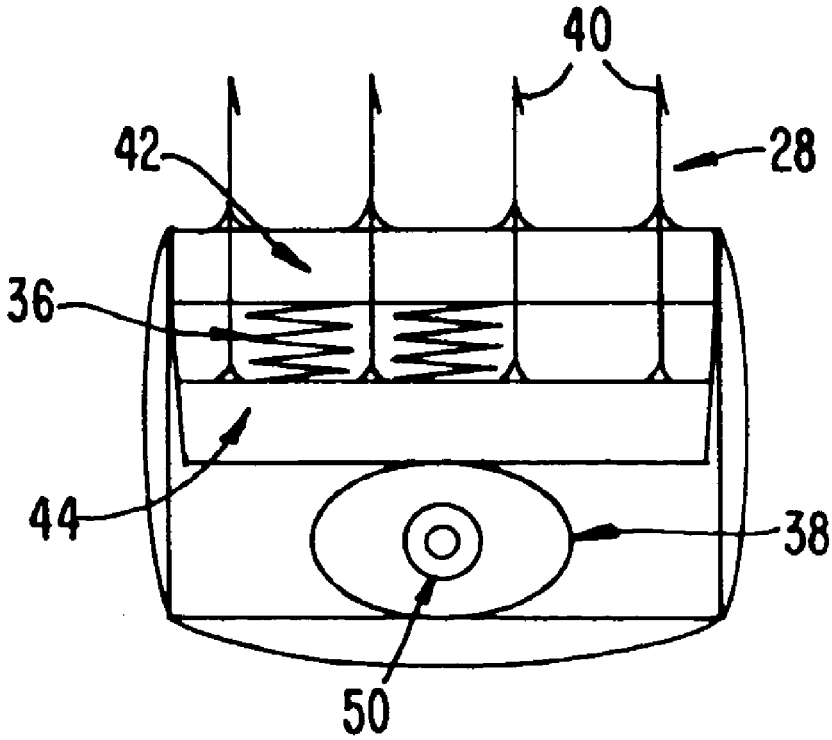
FIG. 4 is a cross-section of the unfolded end piece with needles and retractable barbs in the catch position.

Referring now to FIGS. 3 and 4, the end piece 20 has two halves 22 and 24, each lined with hollow needles 28 housing retractable barbs 40. The halves are connected to the inner tube 34 by rolling pins 18. The rolling pins 18 engage the two halves 22 and 24 at their ends, so that the two halves 22 and 24 can radially unfold until they are flush with each other and orthogonal with the shaft 8, as shown in FIG. 3. The hollow needles 28 penetrate into the suspect's clothing, skin, or surface muscles and preferably stay fixed until the user retracts the retractable barbs 40.

It is also contemplated that the end piece 20 has a handcuff holder 26.

The total surface area of the end piece 20 when the two halves 22 and 24 are unfolded will preferably be between nine and sixteen square inches, and the length of the hollow needles 28 will be one-eighth to one-quarter inch in length. By unfolding into a large, flat surface, the end piece 20 covers a substantial contact surface area, therefore compensating for the loss of accuracy and preparation common in conflict situations.

The end piece 20 is preferably made of material similar to that used to construct the shaft 8, such as carbon fiber. One skilled in the art would appreciate that many other types of materials could be used in accordance with the present invention.

Preferably, the halves 22 and 24 unfold naturally due to the powerful thrust supplied by the air cartridge 6. However, one skilled in the art will appreciate all the numerous other ways to unfold the two halves. For instance, the user could manually unfold them before triggering the device.

In another embodiment, a tube connected to the air cartridge directs a small amount of pressurized gas through the shaft and out of small openings drilled into the needles surface of each half, effectively blowing the halves apart when the trigger is pulled.

In yet another embodiment, springs connect the outside of the halves to the fixed handgrip, pulling the halves open as the end piece launches outward. If the springs are metal, they can further be used to supply electric current to the needles from a separate current source.

Figure 5A:
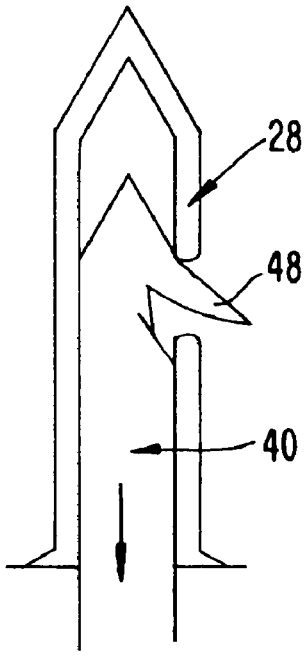
FIG. 5A is a close-up view of the barbs in a catch position.
Figure 5B:
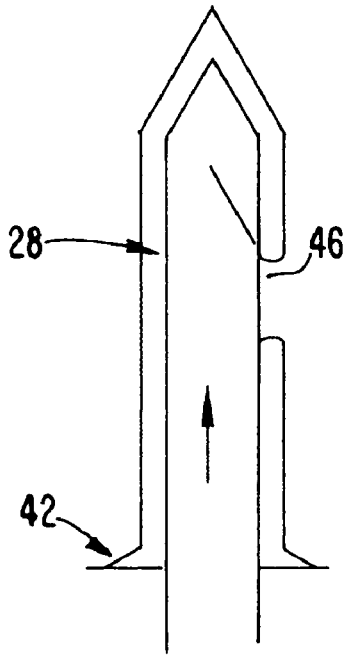
FIG. 5B is a close-up view of the barbs in a retracted position.

Referring now to FIGS. 4, 5A and 5B, the retractable barbs 40 can be in one of two positions: the catch position, as shown in FIG. 5A, or the retracted position, as shown in FIG. 5B.

In general, the surface plate 42 is a fixed part of the end piece's frame, while the middle plate 44 moves up and down. In the catch position, springs 36 continuously apply a force to the middle plate 44 that keeps the middle plate 44 pushed down from the surface plate 42. The catch position is the default position of the device and is the position required to use the retractable barbs 40. If the user wants to switch into the retracted position, the user turns a cam 38 which pushes the middle plate 44 up towards the surface plate 42, retracting the retractable barbs 40 and releasing the suspect. The cam 38, an eccentric wheel mounted on a rotating shaft 50, is well known in the art.

The two positions are described in more detail immediately below.

Regarding the catch position as shown in FIGS. 4 and 5A, the hollow needles 28 are mounted on the surface plate 42. Retractable barbs 40 are mounted on the middle plate 44 and protrude into the hollow needles 28. As a result of the springs 36 pushing the middle plate 44 down from the surface plate 42 within the end piece's frame, the retractable barbs 40, attached to the middle plate 44, are also pushed down. This downward force from the springs 36 causes the retractable barbs 40 to slide partially down and out of the hollow needles 28, causing the barb tips 48 to slide down and out of the openings 46 in the hollow needles 28. This is the catch position.

Regarding the retracted position as shown in FIG. 5B, the user operates the cam 38, located under the middle plate 44, to overcome the downward force of the springs 36 and push the middle plate 44 back up towards the surface plate 42. Preferably there is one cam in each half 22 and 24. Since the retractable barbs 40 are connected to the middle plate 44, the cam also pushes the retractable barbs up towards the surface plate 42. As a result, the barb tips 48 slide back through the openings 15 and the retractable barbs 40 slide back up into the hollow needle 28. This is the retracted position.

Figure 6:
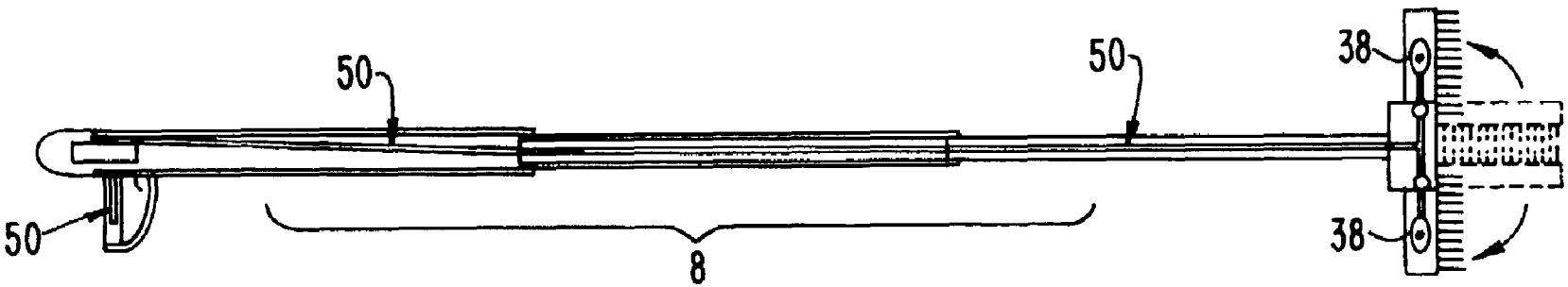
FIG. 6 is a side view of the device after being triggered and the cam shaft.

Regarding the cam as shown in FIG. 6, to retract the retractable barbs 40, the user rotates the rotating cam shaft 50, which is a series of tubes identical to the three tubes 30, 32 and 34 both in design and composition, only smaller. This rotating cam shaft is connected to the cam 38 at one end and preferably the handgrip 2 at the other end, although it does not necessarily have to extend all the way back to the handgrip 2. The user rotates the rotating cam shaft 50 and the cam 38 rotates in an eccentric motion due to its eccentric shape, as depicted in FIGS. 4 and 6. The use of a cam is well-known in the art.

With the aforementioned description of the preferred embodiment in mind, the following paragraphs illustrate how to use the device to catch suspects.

The user grips the handgrip 2 and pulls the trigger 4, releasing a burst of gas from the cartridge 6. This gas travels through the shaft 8 to the end piece 20 and launches the end piece 20 towards the assailant.

As the end piece 20 moves outward, it pulls the inner tube 34 out with it because the two are connected by rolling pins 18. At the same time, the halves 22 and 24 of the end piece 20 unfold, exposing the retractable barbs 40. When the inner tube 34 extends almost all the way out of the middle tube 32, spring buttons 10 from the inner tube lock into spring button holes 12 in the middle tube 32. The inner tube's thrust pulls the middle tube 32 out with it. This process is repeated between the middle and outer tubes, 32 and 30, respectively. The telescoping motion occurs until all the tubes have been fully extended or the barbs 40 have engaged the suspect, whichever occurs first.

The retractable barbs 40 and hollow needles 28 engage the suspect. The needles 9 can simply hold the suspect, or administer tranquilizers, or shock the suspect, or do any number of other things apparent to those skilled in the art of law enforcement. When the user has satisfactorily incapacitated the suspect, the user can rotate the rotating cam shaft 50 to disengage the suspect.

In practice, the entire telescoping motion should occur in a fraction of a second due to the powerful nature of the pressurized burst and the lightweight design of the device.

The invention can be modified in various ways. It should be understood that the terminology which has been used is intended to be in the nature of words of description rather than of limitation. Many modifications and variations of the invention are possible in light of the above teachings. These and other modifications, which will be apparent to those skilled in the art, should be considered within the spirit and scope of the following claims.

I claim:

1. A device for subduing suspects, comprising:

a handgrip, an extendable shaft connected to said handgrip, an end piece connected to said extendable shaft, needles attached to said end piece, wherein said needles are hollow and comprise retractable barbs, and a source of thrust adapted to extend said shaft.

2. The device of claim 1, wherein said end piece is configured to unfold upon use.

3. The device of claim 1, wherein said extendable shaft further comprises a series of tubes.

4. The device of claim 1, wherein said source of thrust comprises an air cartridge.

5. The device of claim 1, further comprising a cam configured to retract said retractable barbs.

* * * * *